US009691217B2

(12) United States Patent
Cox et al.

(10) Patent No.: US 9,691,217 B2
(45) Date of Patent: Jun. 27, 2017

(54) METHOD OF PLAYING A SPORTING EVENT INTERACTIVE BOARD GAME

(71) Applicants: William Anthony Cox, Scottsville, NY (US); Charles Richard Robinson, Caledonia, NY (US)

(72) Inventors: William Anthony Cox, Scottsville, NY (US); Charles Richard Robinson, Caledonia, NY (US)

(73) Assignee: Move the Ball Sports, LLC, Scottsville, NY (US)

( * ) Notice: Subject to any disclaimer, the term of this patent is extended or adjusted under 35 U.S.C. 154(b) by 0 days.

(21) Appl. No.: 14/886,460

(22) Filed: Oct. 19, 2015

(65) Prior Publication Data

US 2016/0253863 A1 Sep. 1, 2016

Related U.S. Application Data

(60) Provisional application No. 61/212,458, filed on Feb. 26, 2015.

(51) Int. Cl.
*A63F 9/24* (2006.01)
*G07F 17/32* (2006.01)

(52) U.S. Cl.
CPC ..... *G07F 17/3216* (2013.01); *G07F 17/3241* (2013.01); *G07F 17/3248* (2013.01); *G07F 17/3276* (2013.01); *G07F 17/3286* (2013.01); *G07F 17/3288* (2013.01)

(58) Field of Classification Search
CPC ..... A63F 2003/00028; A63F 2003/00135
USPC ..... 463/16–20, 40–42
See application file for complete search history.

(56) References Cited

U.S. PATENT DOCUMENTS

| | | | |
|---|---|---|---|
| 6,209,872 | B1 | 4/2001 | Caswell |
| 8,342,946 | B2 | 1/2013 | Amaitis |
| 8,651,957 | B2 | 2/2014 | Goldman |
| 8,790,176 | B2 | 7/2014 | Hopf et al. |
| 9,028,323 | B2 | 5/2015 | Tharp |
| 2005/0239551 | A1 | 10/2005 | Griswold et al. |
| 2012/0095577 | A1 | 4/2012 | Golding |
| 2012/0115554 | A1 | 5/2012 | Caims |
| 2012/0289323 | A1 | 11/2012 | Whitmire |
| 2013/0060362 | A1 | 3/2013 | Murphy et al. |
| 2013/0184039 | A1 | 7/2013 | Steir et al. |
| 2014/0027980 | A1 | 1/2014 | Renier |
| 2014/0302914 | A1 | 10/2014 | Dorfman |

*Primary Examiner* — David L Lewis
*Assistant Examiner* — Ross Williams
(74) *Attorney, Agent, or Firm* — Dunlap Bennett & Ludwig PLLC

(57) ABSTRACT

A method of playing a sporting event interactive board game is provided. A sporting event is displayed on at least one of a television, a computer monitor or other electronic device. The present invention includes a game board. The game board includes a playing surface having a plurality of betting spaces forming a path. Each player may purchase at least one of the betting spaces to play the game. The present invention further includes a chip. A position of the chip is determined randomly and placed on one of the betting spaces. The chip is then moved along the path of the betting spaces based on certain plays performed during the sporting event. When a score or an end of a period occurs during the sporting event, the player who purchased the betting space in which the chip is currently resting is paid.

6 Claims, 5 Drawing Sheets

FIG.4
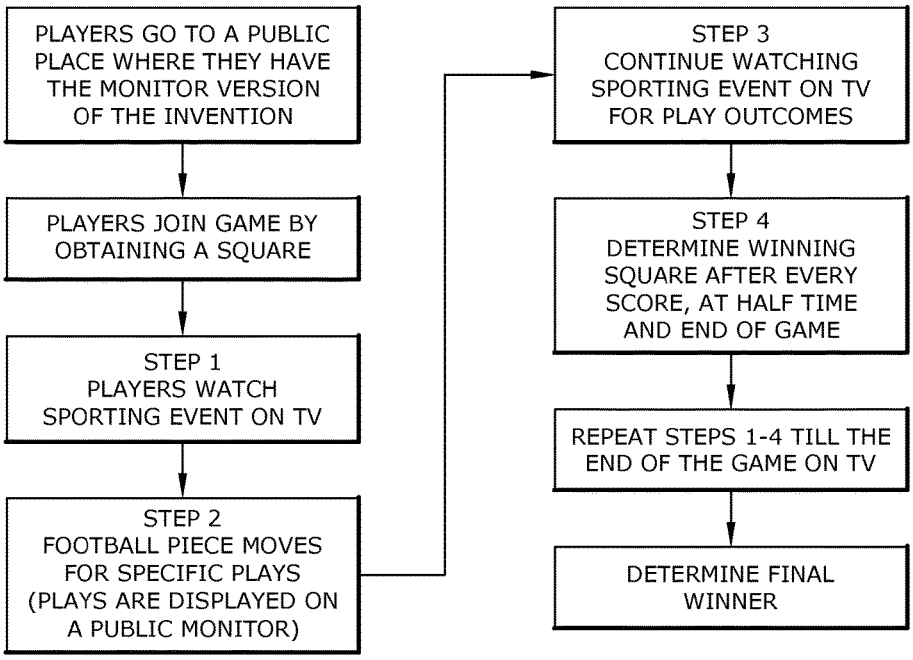
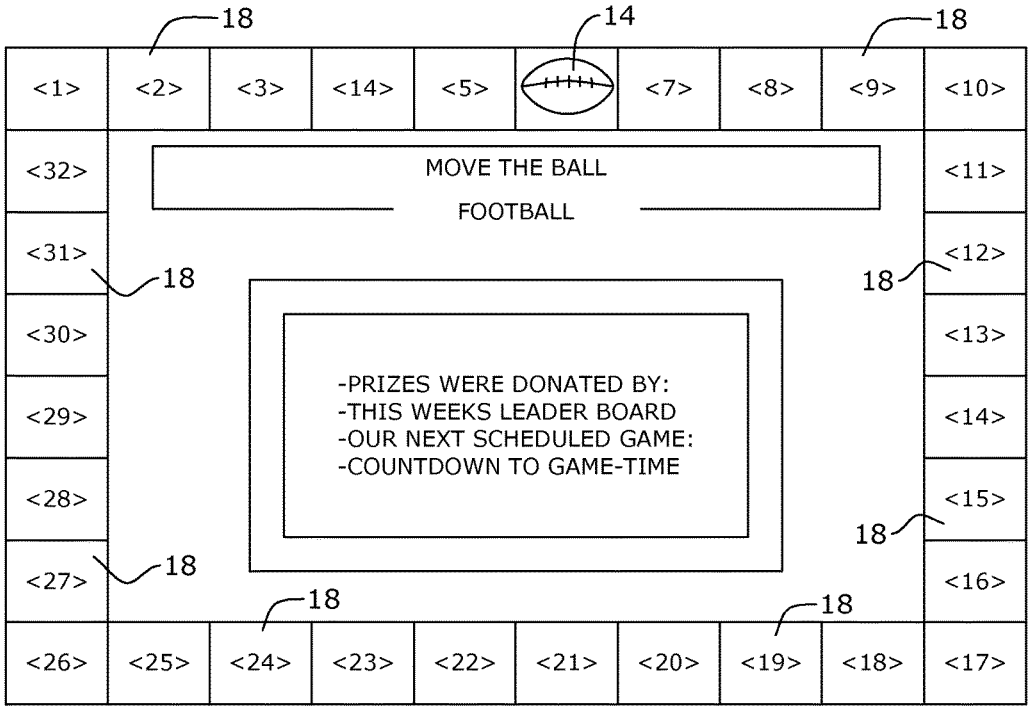
FIG.5

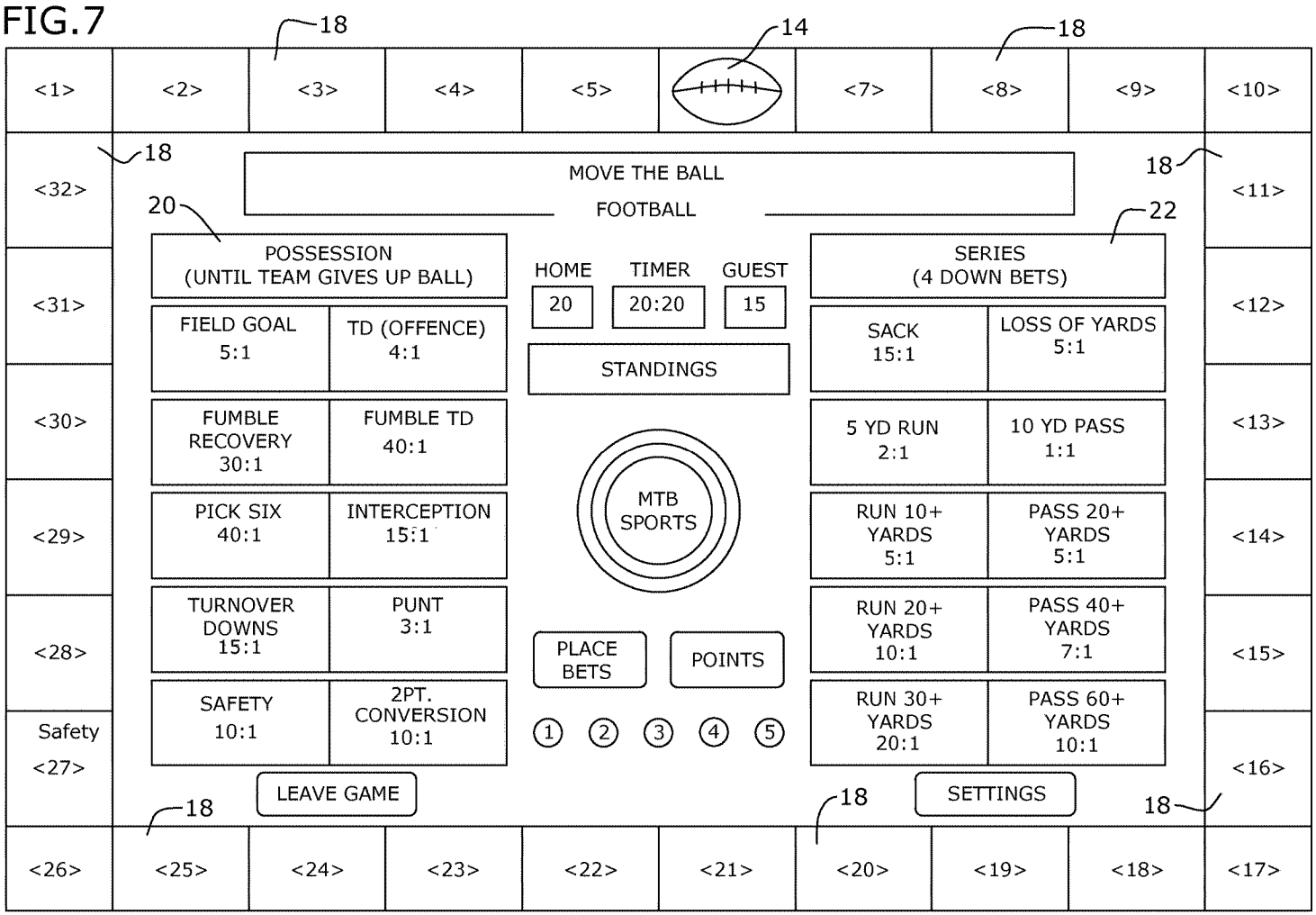
FIG.7
<1>
<2>
<3>
<4>
<5>
<7>
<8>
<9>
<10>
<11>
<12>
<13>
<14>
<15>
<16>
<17>
<18>
<19>
<20>
<21>
<22>
<23>
<24>
<25>
<26>
Safety
<27>
<28>
<29>
<30>
<31>
<32>
14
18
20
22
MOVE THE BALL
FOOTBALL
POSSESSION
(UNTIL TEAM GIVES UP BALL)
FIELD GOAL
5:1
TD (OFFENCE)
4:1
FUMBLE RECOVERY
30:1
FUMBLE TD
40:1
PICK SIX
40:1
INTERCEPTION
15:1
TURNOVER DOWNS
15:1
PUNT
3:1
SAFETY
10:1
2PT. CONVERSION
10:1
LEAVE GAME
HOME
20
TIMER
20:20
GUEST
15
STANDINGS
MTB SPORTS
PLACE BETS
POINTS
1
2
3
4
5
SERIES
(4 DOWN BETS)
SACK
15:1
LOSS OF YARDS
5:1
5 YD RUN
2:1
10 YD PASS
1:1
RUN 10+ YARDS
5:1
PASS 20+ YARDS
5:1
RUN 20+ YARDS
10:1
PASS 40+ YARDS
7:1
RUN 30+ YARDS
20:1
PASS 60+ YARDS
10:1
SETTINGS

METHOD OF PLAYING A SPORTING EVENT INTERACTIVE BOARD GAME

CROSS-REFERENCE TO RELATED APPLICATION

This application claims the benefit of priority of U.S. provisional application No. 62/121,458, filed Feb. 26, 2015, the contents of which are herein incorporated by reference.

BACKGROUND OF THE INVENTION

The present invention relates to a board game and, more particularly, to an interactive sports and board game.

There presently are no board games that use a sporting event to determine how and when to make moves on a board game.

As can be seen, there is a need for a game that is interactive with a sporting event.

SUMMARY OF THE INVENTION

In one aspect of the present invention, a method of playing a sporting event interactive board game comprising: displaying a sporting event on at least one of a television, a computer monitor or other electronic device; providing a game board comprising a playing surface having a plurality of betting spaces forming a path around a perimeter of the game board, wherein each of a plurality of players purchases at least one of the plurality of betting spaces; providing a chip; determining a position of the chip, wherein the position comprises a random selection of one plurality of betting spaces; moving a chip along the path of the plurality of betting spaces based on a plurality of plays performed during the sporting event; and paying a player a monetary value when a score occurs during the sporting event and the chip is positioned on the betting space purchased by the player.

These and other features, aspects and advantages of the present invention will become better understood with reference to the following drawings, description and claims.

BRIEF DESCRIPTION OF THE DRAWINGS

FIG. 4 is a flow chart of a game being played in a group setting with an electronic version of the board game on a monitor;

FIG. 5 is a schematic view illustrating the game being played on an electronic monitor;

FIG. 7 is a schematic view illustrating the game being played on an electronic device.

DETAILED DESCRIPTION OF THE INVENTION

The following detailed description is of the best currently contemplated modes of carrying out exemplary embodiments of the invention. The description is not to be taken in a limiting sense, but is made merely for the purpose of illustrating the general principles of the invention, since the scope of the invention is best defined by the appended claims.

The present invention includes an interactive television sports board game involving watching a sports game on television and playing the board game at the same time. The game of the present invention establishes a set of rules relating to events that happen in a sports game on television and provides a game board and pieces to make moves to determine a winner. The present invention may also include a digital or automated game board that may be played on a computer, such as a smart device.

To play the game, a football game or other sporting event is watched on a television, a computer monitor or other electronic device, and the board game is set up with all the players buying at least one square on the board. By following the game rules and events of the sporting event, moves are made on the board game until a winner is determined when there is a scoring play or an end of a period. An automated or digital version can be developed so participants do not need to be present to play. The present invention may be utilized with football, baseball, basketball, hockey, tennis, golf, and the like.

Figure 1:
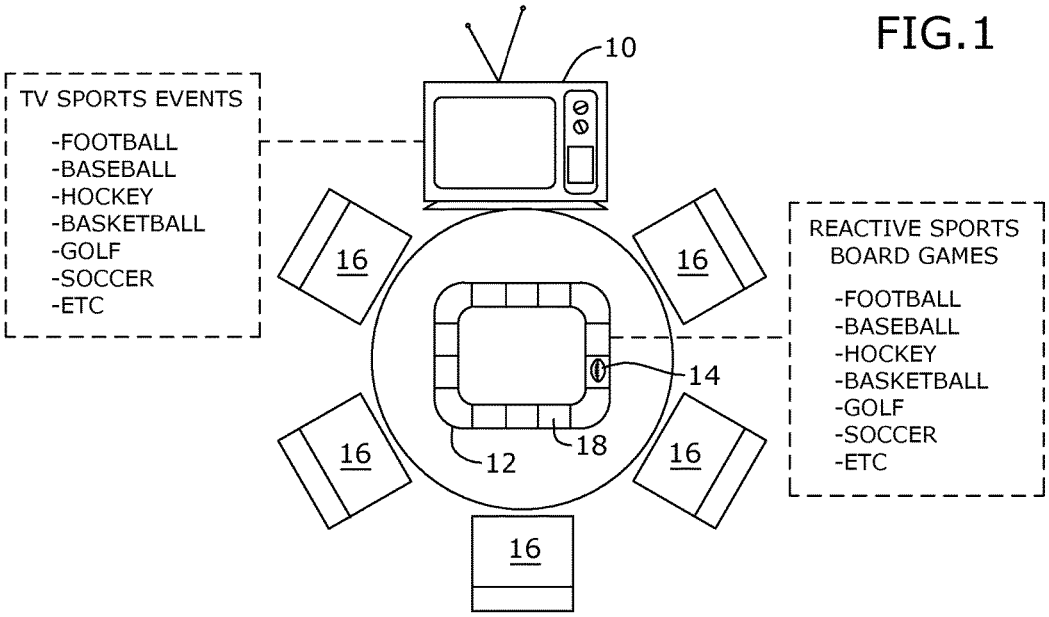
FIG. 1 is a schematic view of the present invention illustrating the game being played as a table board game.
Figure 2:
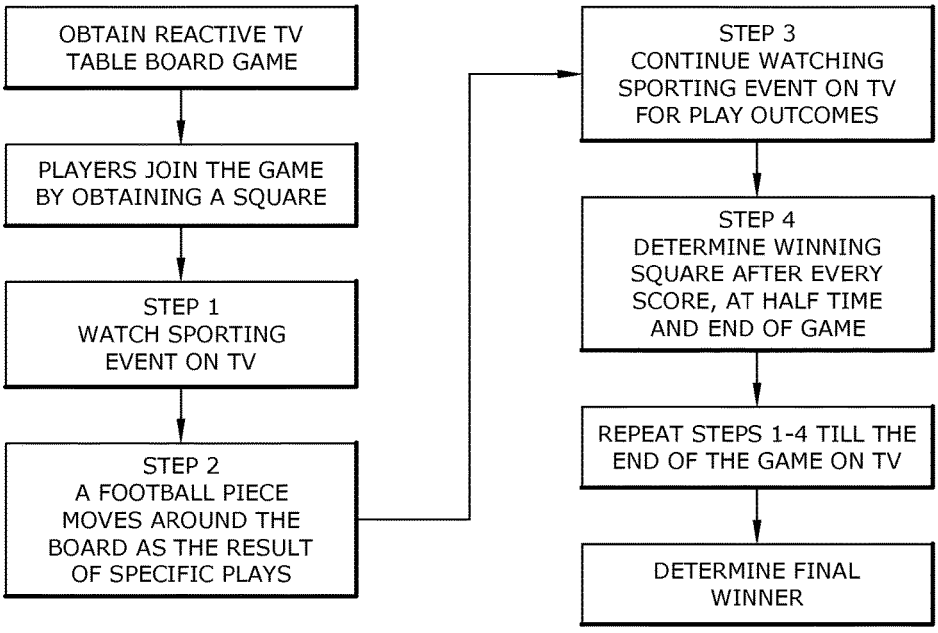
FIG. 2 is a flow chart of an embodiment of how to play the board game version of the present invention.
Figure 3:
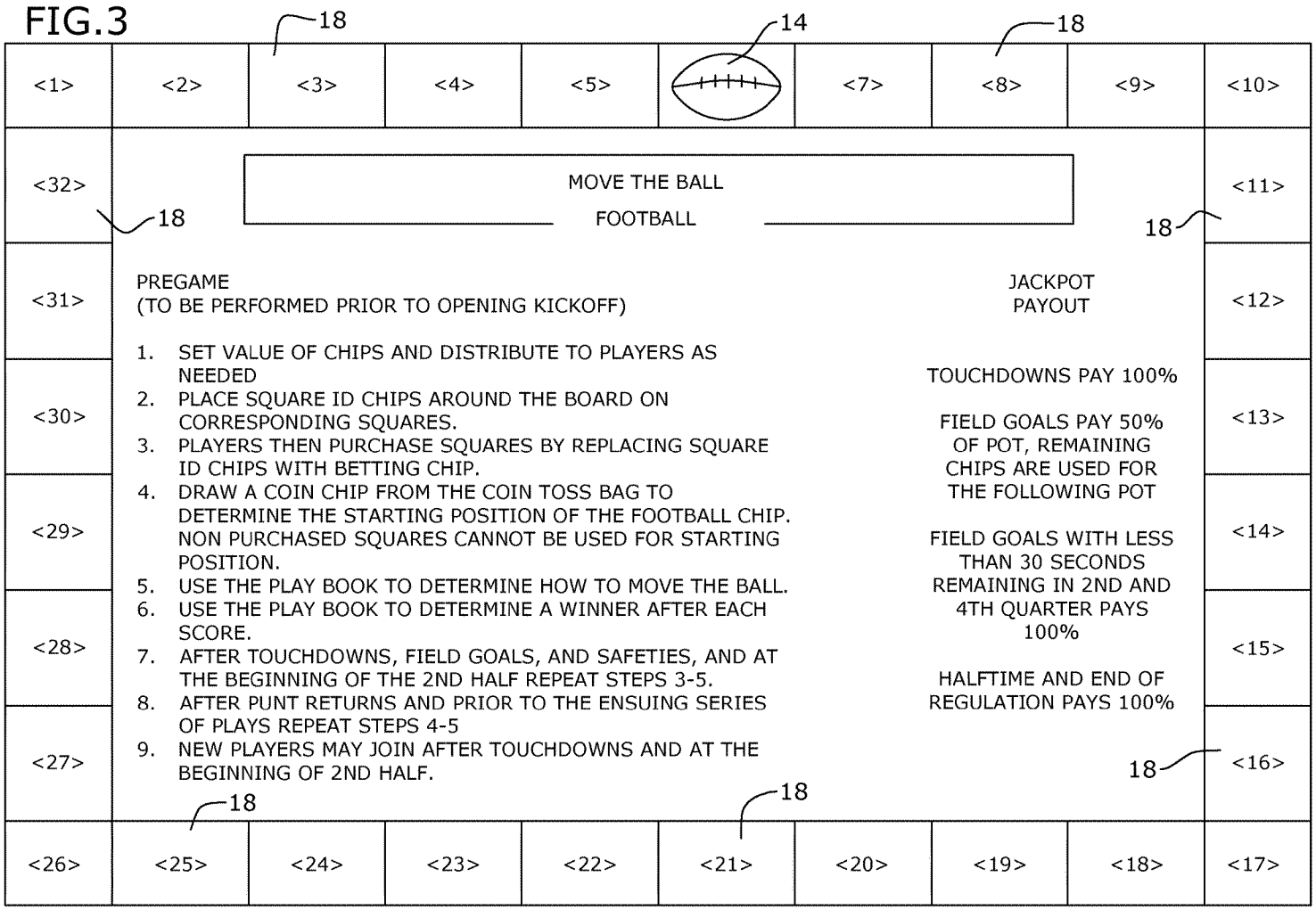
FIG. 3 is a schematic view of the present invention illustrating the table board game.
Figure 6:
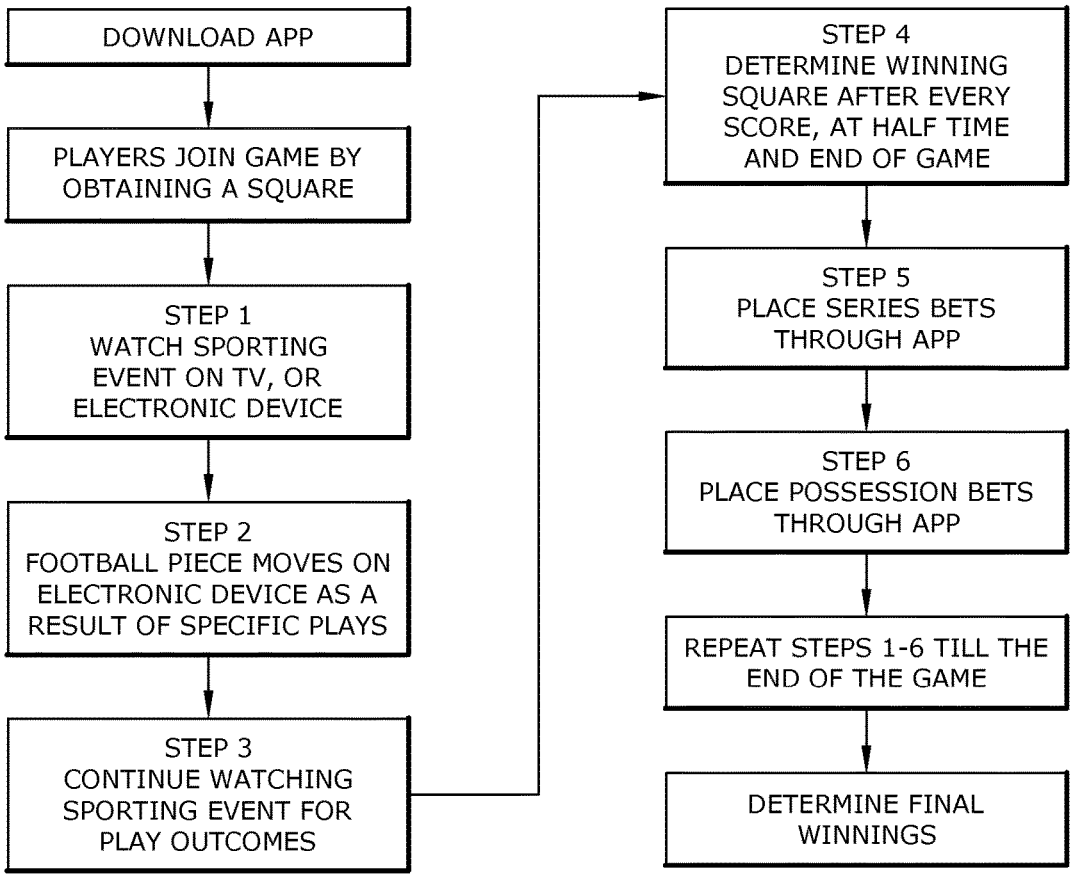
FIG. 6 is a flow chart of the present invention being played on an electronic device.

Referring to FIGS. 1 through 7, the present invention includes a method of playing a sporting event interactive board game. A sporting event is displayed on at least one of a television 10, a computer monitor or other electronic device. The present invention includes a game board 12. The game board 12 includes a playing surface having a plurality of spaces 18 formed in between borders. The plurality of spaces 18 are numbered sequentially and form a looped path on the game board 12. Each player 16 may choose at least one of the spaces 18 to play the game. The present invention further includes a game chip 14. A position of the game chip 14 is determined randomly and placed on one of the spaces 18. The game chip 14 is then moved along the path of the spaces 18 based on certain plays performed during the sporting event. When a score or an end of a period occurs during the sporting event, the player 16 who chose the space 18 in which the player chip 14 is currently resting wins.

To determine the initial spot of the game chip 14, the plurality of spaces 18 may be sequentially numbered. One of the players 16 may randomly draw a number. The game chip 14 is then placed on the space 18 with the corresponding number. The game chip 14 may then either move clockwise or counter clockwise along the path. Once a score or a period ends in the sporting event and a player 16 wins, a random selection occurs again to determine the position of the game chip 14. In certain embodiments, a play in the sporting event determines whether the game chip 14 is moving clockwise or counter clockwise. For example, the game chip 14 may start off moving counter clockwise. If there is a turnover during the sporting event, the game chip 14 may then start moving clockwise.

In certain embodiments, the present invention may include a plurality of identification chips and a plurality of player chips. Each of the plurality of identification chips covers one of the spaces 18. When the player 16 purchases a space 18, the identification chips are then replaced with a player chip to identify which spaces 18 have been purchased by whom. In certain embodiments, no more than one player 16 can purchase each of the plurality of spaces 18.

As mentioned above, the present invention may be played on a physical game board or on an electronic game board. The electronic game board may be played in a central location, such as a sports bar or restaurant. The players may enter the game and purchase betting spaces 18 using an electronic device. An electronically displayed chip may automatically move about the path when a play has been made in the live sporting event. In alternate embodiments, the present invention may be played remotely via a software application on a smart device, such as a computer, laptop, tablet, phone, and the like.

Each game may include a "playbook" to describe the rules. Different sports would include different playbooks. Below is an example of a playbook for an American football sporting event interactive game.

The Playbook

Table of Contents

The Game . . . Section 1
Game Pieces . . . Section 2
Glossary . . . Section 3
The Rules . . . Section 4
Kickoff . . . Section 4.1
Offensive Play . . . Section 4.2
Punts . . . Section 5
Field Goal Attempts . . . Section 6
Jackpots . . . Section 7
Overtime Rules . . . Section 8

Section 1: THE GAME

Move The Ball Football is a interactive sports television game. It is designed to be played while watching a live broadcast of a football game, so you're going to want the TV to be visible to everyone. It's important the "score banner" (the small, on screen graphic showing the score, clock, and down/distance) be visible as well, as this will show the "down and distance" of an ensuing play. Before the game begins use the "Pre Game" section on the board to get started. Once you're set up and ready to go refer to the PLAY BOOK to determine how and when to move the FOOTBALL CHIP. Use the COIN TOSS CHIPS to determine the random starting locations of the FOOTBALL CHIP. It is important to know what kind of play is taking place. There are only 4 different "formations" or types of plays: Kickoff, Offensive, Punt, and Field Goal. Use these formations to determine which set of rules you should be using on a particular play. During Offensive plays use the down and yardage displayed on the TV score banner to determine if the previous play resulted in a positive gain, or a loss of yardage. For example, a play begins on $1^{st}$ down and 10 yards to go. Before the following play the TV banner displays $2^{nd}$ down and 8 yards to go. This means that on $1^{st}$ down there was a gain of 2 yards. Positive gains by the offense result in a move 1 square forward as you will see in the "Offensive Plays" section. Penalties do not count in the game. The ball cannot be moved by a penalty. Most penalties negate the result of a play however if a penalty is declined then the play counts. If a penalty results in the addition of yardage on the end of a play then use that result as a positive gain. If a penalty negates the play and it must be repeated do not move the FOOTBALL CHIP. Holding for example will negate a positive gain for the offense, and that down must be repeated. Incomplete passes and plays that gain 0 yards are considered "NO MOVE PLAYS". Other "NO MOVE PLAYS" include QB spikes, touchbacks, fair catches, and downed punts. ALL TURNOVERS RESULT IN A MOVE ONE SPACE BACKWARDS AND THIS DIRECTION IS MAINTAINED UNTIL THE NEXT TURNOVER, PUNT, OR KICKOFF. While you may be confused at this point don't be, simply determine the type of play and refer to that section of "The PLAY BOOK to see all the possible outcomes of a play, and the corresponding move. Remember that safeties and field goals increase the size of the ensuing jackpot, as described under "Jackpots" in the PLAY BOOK and you MUST REPURCHASE YOUR SQUARE before the ensuing kickoff.

Section 2: Game Pieces

Item #1—"The Game Board"
- Used to determine each players position in the game and the movement of THE FOOTBALL CHIP.
- Used to determine a winner of the "Jack Pot"
- Has the basic rules on it Item #2—"Coin Toss Bag" (or) Computer Generated Random Draw
- Used to hold the COIN TOSS CHIPS so a blind draw can take place to determine the starting position of THE FOOTBALL CHIP Item #3—"Coin Toss Chips numbered 1 thru 32" (or) random Draw
- 32 coin chips are placed in the COIN TOSS BAG or a computer generated random draw
- Before kickoffs and after punts coin toss determines starting position of the FOOTBALL CHIP on the board
- If the COIN TOSS CHIP drawn does not match a square that was purchased by a player draw another chip from the coin toss bag Item #4—"The Football Chip" (or) Piece
- Moves around the board clockwise to start the game.
- The direction the ball moves is reversed by a turnover
- After scores and punts the direction always resets to clockwise Item #5—"Square ID Chips" (or) Player Profile
- When a player purchases a square they replace the SQUARE ID CHIP on the board with a BETTING CHIP
- After a score the SQUARE ID CHIP must be returned to the board, or repurchased using a BETTING CHIP
- New Players can only enter the game at halftime or after a TD Item #6—"Game Case" (or) Smart Phone/Electronic Device
- Used to hold all of the components of the MOVE THE BALL FOOTBALL.

Item #7—"Betting Chips"
- used to purchase squares and re-ante after a TD or Field Goal
- after a score BETTING CHIPS are distributed to winner as described in the "Jackpot" section Item #8—"The Playbook " (or) Settings/Rules
- contains all the rules and explains how to move the ball during kickoffs, offensive snaps, punts and field goal attempts.

Section 3: Glossary:
- Ball Carrier—The player who owns the square the football is on is known as the "ball carrier"
- Defense—The player who owns a square directly behind ball carrier is the "defense"
- Ante—The cost of one square on the board.
- Jackpot—The Betting Chips in the center of the Board during play.
- Coin Toss—The process of drawing a Coin Toss Chip out of the Coin Toss Bag to determine the starting position of the Football Chip
- Reset the Game—When players Re-Ante to purchase their square and a Coin Toss Chip is drawn.
- Turnover—is when the offense gives up the ball without punting the ball. It results in moving the football one space backwards and this direction is continued until the next turnover or "Coin Toss".

Section 4: The Rules

Moving the ball—After any "Coin Toss" The FOOTBALL CHIP is placed on that square and begins moving clockwise. After a turnover the FOOTBALL CHIP is moved 1 square backwards (opposite direction) and continues to move in that direction until another turnover or "Coin Toss".

Section 4.1: KICKOFF

Any return attempt: MOVE ONE SPACE FORWARD
Touchbacks and kicks out of bounds: NO MOVE
Successful onside kick: TURNOVER
Lost fumble during return: TURNOVER
Return for touchdown: JACKPOT to BALL CARRIER
Kicking team recovers in end zone: JACKPOT to DEFENSE Section 4.2: OFFENSIVE SNAPS Any play resulting in a 1-19 yard positive gain: MOVE 1 SPACE FORWARD
Any play resulting in a 20-29 yard positive gain: MOVE 2 SPACES FORWARD
Any play resulting in a 30-39 yard positive gain: MOVE 3 SPACES FORWARD
Any play resulting in a 40-49 yard positive gain: MOVE 4 SPACES FORWARD
Any play resulting in a 50-59 yard positive gain: MOVE 5 SPACES FORWARD
Any play resulting in a 60-69 yard positive gain: MOVE 6 SPACES FORWARD
Any play resulting in a 70-79 yard positive gain: MOVE 7 SPACES FORWARD
Any play resulting in a 80-89 yard positive gain: MOVE 8 SPACES FORWARD
Any play resulting in a 90-99 yard positive gain: MOVE 9 SPACEs FORWARD
Any play resulting in a loss of yardage: MOVE 1 SPACE BACKWARD
Any play resulting in a gain of 0 yards: NO MOVE
Fumble/Interception/Unsuccessful $4^{th}$ down: TURNOVER
Pass/Run for Touchdown: JACKPOT to BALL CARRIER
Fumble/Interception returned for touchdown: JACKPOT to DEFENSE
Any play beginning at the 20 yard line or closer is considered a RED ZONE PLAY. ALL RED ZONE PLAYS RESULT IN A MOVE 1 SPACE FORWARD except for "Turnovers"

Section 5: PUNTS returns for touchdowns (blocked punts included): JACKPOT to BALL CARRIER
Returns, touchbacks, fair catches, downed punts: COIN TOSS
Lost fumbles on punts are treated as offensive first downs: MOVE ONE SPACE FORWARD
Fake punts/fumbled snaps are treated as offensive snaps; depending on result of play refer to OFFENSIVE PLAYS for move.

Section 6: FIELD GOAL ATTEMPTS

Fake FGs, Blocked FGs and fumbled snaps are treated as offensive plays
Missed field goals are treated as turnovers.
Completed field goals: ½ JACKPOT TO BALL CARRIER Section 7: JACKPOTS Offensive Touchdown: Pay the ball carrier, reset game.
Defensive Touchdown: Pay the defense, reset game
Kickoff and punt returns for touchdowns pay the ball carrier, reset game
Successful Field goals pay the ball carrier ½ of the pot, reset game. If there is less than 30 seconds left at the Half or the end of the game, do not re-ante and leave half of the pot there for the kick off.
Safety. Reset game (Pot increases 1 Betting Chip per player) the following free kick treated as KICKOFF.

Section 8: Overtime Rules

Overtime begins the same way the regular game begins however the scores and jackpots are treated differently.
On first touchdown JACKPOT TO BALL CARRIER
If first team scores a field goal PAY THE BALL CARRIER HALF THE POT no ante
If there is a field goal on the next possession PAY THE BALL CARRIER HALF THE POT AND REANTE. Continue with the game and on the next score PAY THE BALL CARRIER FULL POT.
If on the second possession there is no tying field goal, pay the defense after the final play.
Penalties and conversion plays require no action.

It should be understood, of course, that the foregoing relates to exemplary embodiments of the invention and that modifications may be made without departing from the spirit and scope of the invention as set forth in the following claims.

What is claimed is:

1. A method of playing a sporting event interactive board game comprising:

displaying a sporting event on at least one of a television or a computer monitor;
providing a game board comprising a playing surface comprising a plurality of lines forming borders, wherein a plurality of spaces are formed in between the borders, wherein the plurality of spaces are numbered sequentially and form a looped path on the game board;
providing a plurality of identification chips each covering one of the spaces;
providing a plurality of player chips, wherein each player picks at least one of the spaces and replaces the identification chip covering the space with their respective player chip;
providing a game chip;
placing the game chip at a position on the game board, wherein the position comprises a random selection of one of the plurality of spaces;
moving the game chip a along the path of the plurality of spaces based on a plurality of plays performed during the sporting event; and
determining a winner of the game when a score or an end of a period occurs during the sporting event, wherein an owner of the player chip on the space with the game chip is the winner of the game.

2. The method of claim 1, wherein the plurality of spaces are sequentially numbered from one up to thirty two.

3. The method of claim 2, wherein the random selection comprises the step of drawing a number and placing the game chip on the space comprising a corresponding number.

4. The method of claim 1, wherein the game chip moves clockwise or counter clockwise along the path.

5. The method of claim 4, wherein a play in the sporting event determines whether the game chip is moving clockwise or counter clockwise.

6. The method of claim 1, further comprising the step of determining a position of the game chip on the game board after determining the winner, wherein the position comprises a random selection of one of the plurality of spaces.

* * * * *